US011320765B2

(12) United States Patent
Shibata et al.

(10) Patent No.: US 11,320,765 B2
(45) Date of Patent: May 3, 2022

(54) POWDER CONTAINER, POWDER SUPPLY DEVICE, AND IMAGE FORMING APPARATUS HAVING LARGE DIAMETER AND SMALL DIAMETER PORTIONS

(71) Applicants: Ricoh Company, Ltd., Tokyo (JP); Yasushi Tanaka, Tonami (JP)

(72) Inventors: Teruo Shibata, Shizuoka (JP); Yuuta Tanaka; Seiji Terazawa, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/225,292

(22) Filed: Apr. 8, 2021

(65) Prior Publication Data

US 2021/0325800 A1 Oct. 21, 2021

(30) Foreign Application Priority Data

Apr. 20, 2020 (JP) ..... JP2020-074624

(51) Int. Cl.
*G03G 15/08* (2006.01)

(52) U.S. Cl.
CPC ..... *G03G 15/0891* (2013.01); *G03G 15/087* (2013.01); *G03G 15/0867* (2013.01); *G03G 2215/0663* (2013.01); *G03G 2215/0668* (2013.01); *G03G 2215/0678* (2013.01)

(58) Field of Classification Search
CPC ..... G03G 15/0891; G03G 15/0865; G03G 15/0867; G03G 15/087; G03G 15/0872; G03G 2215/0663; G03G 2215/0668; G03G 2215/0675; G03G 2215/0678
See application file for complete search history.

(56) References Cited

U.S. PATENT DOCUMENTS 3,729,114 A * 4/1973 Mari ..... A47G 7/06 220/504
6,097,903 A * 8/2000 Yahata ..... G03G 15/0822 399/106
2002/0001485 A1* 1/2002 Ichikawa ..... G03G 15/0872 399/262
2002/0102113 A1 8/2002 Kusano et al.
2013/0216269 A1 8/2013 Yamabe et al.
(Continued)

FOREIGN PATENT DOCUMENTS

JP 2002-221858 8/2002
JP 2005-107392 4/2005
JP 2013-083875 5/2013

*Primary Examiner* — Walter L Lindsay, Jr.
*Assistant Examiner* — Laura Roth
(74) *Attorney, Agent, or Firm* — Xsensus LLP

(57) ABSTRACT

A powder container includes a powder container body having a cylindrical form to store powder. The powder container body includes a conveyer, a large diameter portion, a small diameter portion, and a boundary portion. The conveyer conveys the powder stored in the powder container body in a longitudinal direction of the powder container body. The large outer diameter portion has an outer diameter on a cross section orthogonal to the longitudinal direction. The small outer diameter portion has an outer diameter smaller than the outer diameter of the large outer diameter portion on the cross section. The boundary portion connects the large outer diameter portion and the small outer diameter portion.

12 Claims, 5 Drawing Sheets

(56) References Cited

U.S. PATENT DOCUMENTS

| | | | | |
|---|---|---|---|---|
| 2014/0270859 | A1* | 9/2014 | Hosokawa | G03G 15/0865 399/262 |
| 2015/0293474 | A1 | 10/2015 | Mitsuishi et al. | |
| 2016/0033898 | A1 | 2/2016 | Yamabe et al. | |
| 2016/0124346 | A1 | 5/2016 | Yamabe et al. | |
| 2016/0161885 | A1 | 6/2016 | Hosokawa et al. | |
| 2016/0202632 | A1 | 7/2016 | Mitsuishi et al. | |
| 2016/0252846 | A1 | 9/2016 | Suiseki et al. | |
| 2017/0102638 | A1 | 4/2017 | Yamabe et al. | |
| 2017/0139350 | A1 | 5/2017 | Yano et al. | |
| 2019/0243286 | A1 | 8/2019 | Tanaka et al. | |
| 2020/0142331 | A1 | 5/2020 | Hosokawa et al. | |
| 2020/0192243 | A1 | 6/2020 | Kitamura et al. | |

* cited by examiner

POWDER CONTAINER, POWDER SUPPLY DEVICE, AND IMAGE FORMING APPARATUS HAVING LARGE DIAMETER AND SMALL DIAMETER PORTIONS

CROSS-REFERENCE TO RELATED APPLICATION

This patent application is based on and claims priority pursuant to 35 U.S.C. § 119(a) to Japanese Patent Application No. 2020-074624, filed on Apr. 20, 2020 in the Japan Patent Office, the entire disclosure of which is incorporated by reference herein.

BACKGROUND

Technical Field

The present disclosure generally relates to a powder container to store powder such as toner therein, a powder supply device including the powder container, and an image forming apparatus including the powder supply device.

Related Art

Image forming apparatuses such as copiers, printers, facsimile machines, and multifunction peripherals (MFPs) having at least two of copying, printing, facsimile transmission may include cylindrical toner container as a powder container that is detachably attached.

SUMMARY

This specification describes an improved powder container that includes a powder container body having a cylindrical form. The powder container is configured to store powder. The powder container includes a conveyer, a large outer diameter portion, a small outer diameter portion, and a boundary portion. The conveyer is configured to convey the powder stored in the powder container body in a longitudinal direction of the powder container body. The large outer diameter portion has an outer diameter on a cross section orthogonal to the longitudinal direction. The small outer diameter portion has an outer diameter smaller than the outer diameter of the large outer diameter portion on the cross section. The boundary portion connects the large outer diameter portion and the small outer diameter portion.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
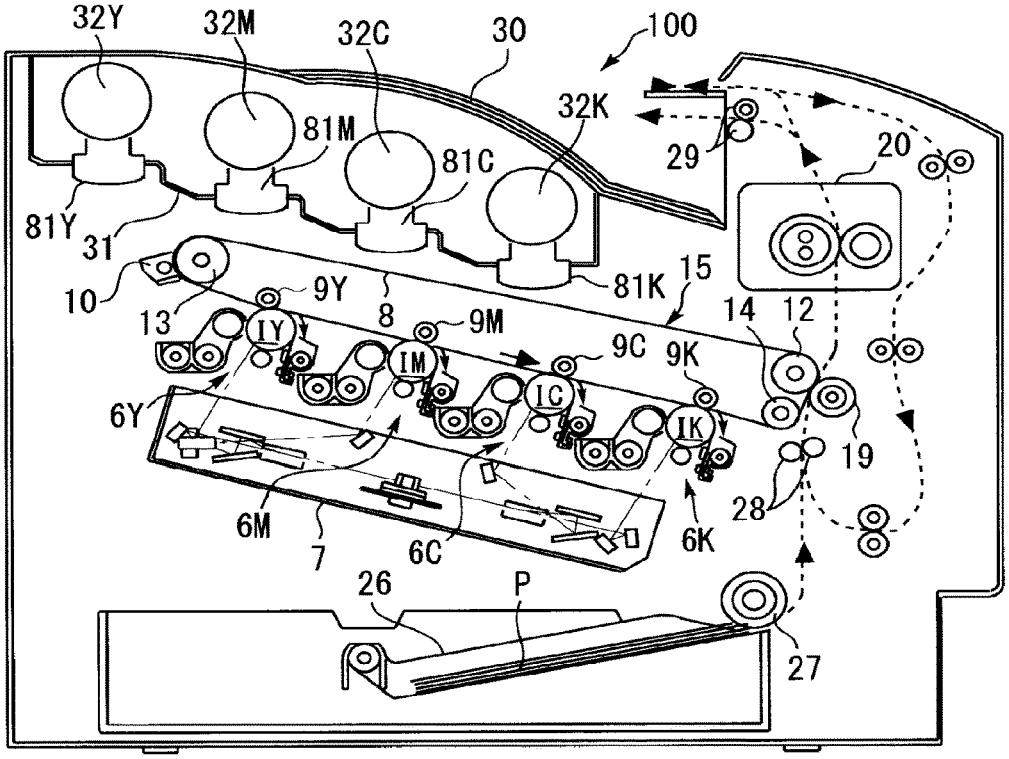
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

Figure 2:
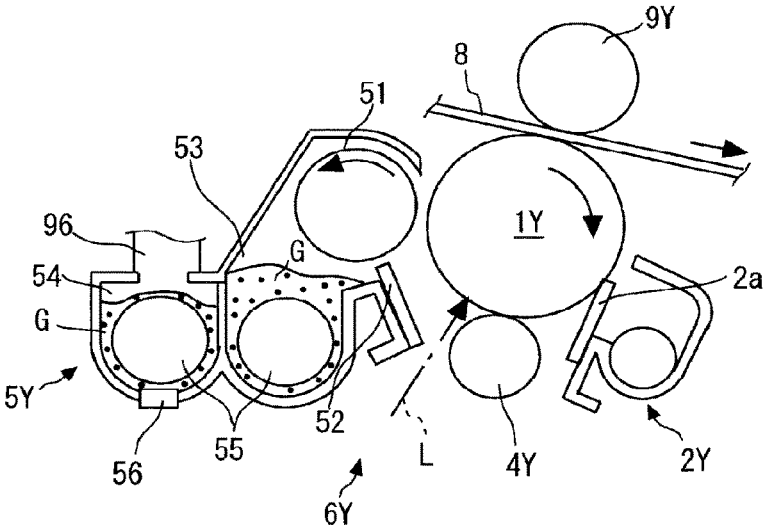
FIG. 2 is a cross-sectional view of an image forming device of the image forming apparatus in FIG. 1.
Figure 3:
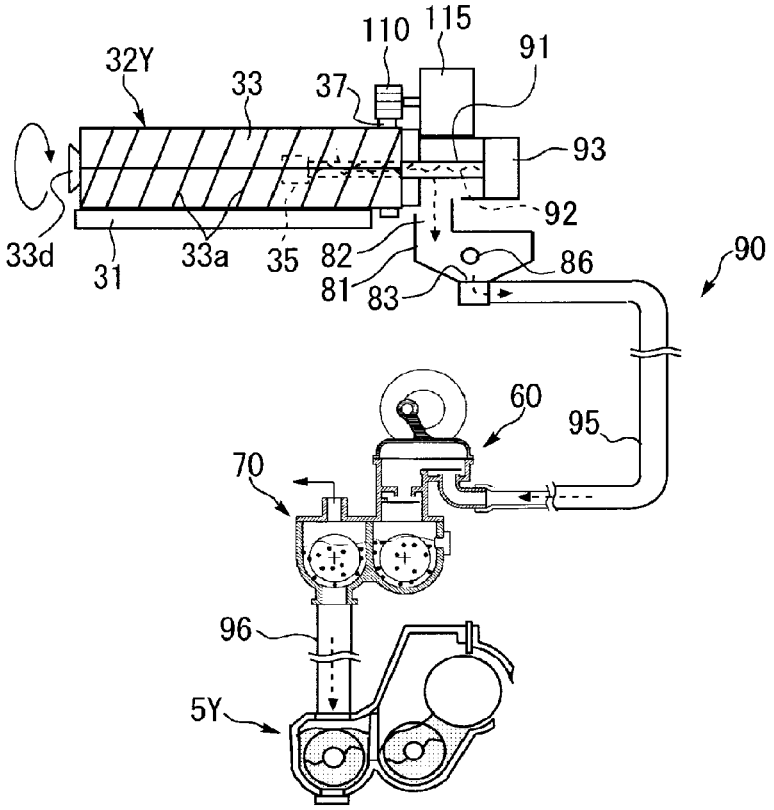
FIG. 3 is a schematic view of a toner supply device of the image forming apparatus in FIG. 1.

With reference to FIGS. 1 to 3, a configuration and operation of an image forming apparatus is described below.

FIG. 1 is a schematic view illustrating the configuration of a printer as the image forming apparatus. FIG. 2 is an enlarged view of an image forming device in the printer. FIG. 3 is a schematic view of a toner supply device of the image forming apparatus and parts near the toner supply device.

As illustrated in FIG. 1, an image forming apparatus body 100 includes an installation port 31 serving as a toner container rack in which four toner containers 32Y, 32M, 32C, and 32K are removably installed. That is, each toner container can be replaced. The four toner containers 32Y, 32M, 32C, and 32K serve as powder containers have substantially cylindrical forms, and correspond to four colors: yellow, magenta, cyan, and black, respectively. Under the toner containers 32Y, 32M, 32C, and 32K, hoppers 81Y, 81M, 81C, and 81K of toner supply devices are disposed, respectively.

Below the installation port 31, the intermediate transfer device 15 is disposed. The intermediate transfer device 15 includes an intermediate transfer belt 8 facing image forming devices 6Y, 6M, 6C, and 6K arranged side by side corresponding to yellow, magenta, cyan, and black, respectively.

With reference to FIG. 2, the image forming device 6Y corresponding to yellow is described. The image forming device 6Y includes a photoconductor drum 1Y as an image bearer around which a charger 4Y, a developing device 5Y, a cleaner 2Y, and a discharger are disposed. On the photoconductor drum 1Y, image forming processes (e.g. a charging process, an exposure process, a developing process, a transfer process, and a cleaning process) are preformed to form a yellow toner image on the photoconductor drum 1Y.

The image forming devices 6Y, 6M, 6C and 6K have substantially the same configurations, differing from each other only in the color of toner employed. The image forming devices 6Y, 6M, 6C and 6K perform the same series of image forming processes to form toner images of the respective colors. Thus, only the image forming device 6Y is described below and descriptions of other image forming devices 6M, 6C, and 6K are omitted.

As illustrated in FIG. 2, the photoconductor drum 1Y is rotated clockwise in FIG. 2 by a motor. The charger 4Y uniformly charges the surface of the photoconductor drum 1Y, which is referred to as the charging process.

When the photoconductor drum 1Y reaches a position to receive a laser beam L emitted from the exposure device 7 (i.e., a writing device), the photoconductor drum 1Y is scanned with the laser beam L, and thus an electrostatic latent image for yellow is formed thereon, which is referred to as the exposure process.

After the electrostatic latent image is formed on the surface of the photoconductor drum 1Y, the photoconductor drum 1Y is rotated further and reaches a position opposite the developing device 5Y. The developing device 5Y develops the electrostatic latent image into a visible toner image of yellow at the position, which is referred to as the developing process. After the developing process, the yellow toner image formed on the photoconductor drums 1Y reaches a primary transfer nip formed between the photoconductor drum 1Y and the intermediate transfer belt 8 by a primary transfer bias roller 9Y pressed against the photoconductor drum 1Y via the intermediate transfer belt 8, and the yellow toner image formed on the photoconductor drum 1Y is primarily transferred onto the intermediate transfer belt 8, which is referred to as a primary transfer process. After the primary transfer process, a certain amount of untransferred toner remains on the photoconductor drum 1Y.

When the surface of the photoconductor drum 1Y reaches a position facing the cleaner 2Y, a cleaning blade 2*a* of the cleaner 2Y mechanically collects the untransferred toner on the photoconductor drum 1Y, which is referred to as the cleaning process.

Subsequently, the surface of the photoconductor drum 1Y reaches a position facing the discharger, and the discharger removes residual potential from the photoconductor drum 1Y.

Thus, the series of image forming processes performed on the surface of the photoconductor drum 1Y is completed.

The above-described image forming processes are performed in the image forming devices 6M, 6C, and 6K similarly to the image forming device 6Y for yellow. That is, the exposure device 7 disposed below the image forming devices 6Y, 6M, 6C, and 6K irradiates photoconductor drums 1M, 1C, and 1K of the image forming devices 6M, 6C, and 6K with the laser beams L based on image data. Specifically, the exposure device 7 includes a light source to emit the laser beams L, multiple optical elements, and a polygon mirror that is rotated by a motor. The exposure device 7 scans, with the laser beams L, the photoconductor drums 1M, 1C, and 1K via the multiple optical elements while deflecting the laser beams L with the polygon mirror.

The toner images formed on the photoconductor drums 1Y, 1M, 1C, and 1K through the developing process are transferred therefrom and superimposed on the intermediate transfer belt 8. Thus, a multicolor toner image is formed on the intermediate transfer belt 8.

The intermediate transfer device 15 includes the intermediate transfer belt 8, the four primary transfer bias rollers 9Y, 9M, 9C, and 9K, a secondary transfer backup roller 12, a cleaning backup roller 13, a tension roller 14, and an intermediate transfer belt cleaner 10. The intermediate transfer belt 8 is stretched taut across and supported by the three rollers, that is, the secondary transfer backup roller 12, the cleaning backup roller 13, and the tension roller 14. One of the three rollers, that is, the secondary transfer backup roller 12 drives and rotates the intermediate transfer belt 8 in a rotation direction indicated by arrow in FIG. 1.

The four primary transfer bias rollers 9Y, 9M, 9C, and 9K sandwich the intermediate transfer belt 8 together with the four photoconductor drums 1Y, 1M, 1C, and 1K, respectively, thus forming the four primary transfer nips between the intermediate transfer belt 8 and the photoconductor drums 1Y, 1M, 1C, and 1K. The primary transfer bias rollers 9Y, 9M, 9C, and 9K are applied with a primary transfer bias having a polarity opposite a polarity of electric charge of toner.

The intermediate transfer belt 8 is moved in the direction indicated by arrow in FIG. 1 and sequentially passes through the primary transfer nips formed by the primary transfer bias rollers 9Y, 9M, 9C, and 9K. Thus, the yellow, magenta, cyan, and black toner images on the photoconductor drums 1Y, 1M, 1C, and 1K are primarily transferred to and superimposed on the intermediate transfer belt 8, thereby forming a multicolor toner image.

Subsequently, the intermediate transfer belt 8 bearing the multicolor toner image reaches a position opposite the secondary transfer roller 19. At the position, the intermediate transfer belt 8 is sandwiched between the secondary transfer backup roller 12 and the secondary transfer roller 19 to form a secondary transfer nip. The yellow, magenta, cyan, and black toner images superimposed on the intermediate transfer belt 8 are secondarily transferred onto a sheet P conveyed through the secondary transfer nip in a secondary transfer process. At this time, untransferred toner that is not transferred onto the sheet P remains on the surface of the intermediate transfer belt 8.

After the secondary transfer process, the intermediate transfer belt 8 reaches a position opposite the intermediate transfer belt cleaner 10. At the position, the intermediate transfer belt cleaner 80 collects the untransferred toner from the intermediate transfer belt 8.

Thus, a series of transfer processes performed on the surface of the intermediate transfer belt 8 is completed.

The sheet P is conveyed from a sheet feeder 26 disposed in a lower portion of the image forming apparatus body 100 to the secondary transfer nip via a sheet feeding roller 27 and a registration roller pair 28.

Specifically, the sheet feeder 26 accommodates a stack of multiple sheets P. As the sheet feeding roller 27 rotates counterclockwise in FIG. 1, the sheet feeding roller 27 feeds an uppermost sheet P in the sheet feeder 26 to a roller nip between the registration roller pair 28.

The sheet P is conveyed to a position of the registration roller pair 28 as a timing roller pair and temporarily stops at the roller nip between the registration roller pair 28 that stops rotating. Subsequently, the registration roller pair 28 rotates to convey the sheet P to the secondary transfer nip, timed to coincide with the arrival of the multicolor toner image on the intermediate transfer belt 8, and the secondary transfer roller 19 transfers the desired multicolor toner image onto the sheet P.

After the secondary transfer roller 19 transfers the multicolor image onto the sheet P at the secondary transfer nip, the sheet P is conveyed to a fixing device 20. In the fixing device 20, a fixing roller and a pressure roller apply heat and pressure to the sheet P to fix the multicolor toner image on the sheet P.

Thereafter, the sheet P bearing the fixed toner image is conveyed through a roller nip formed by an output roller pair 29 and ejected by the output roller pair 29 onto an outside of the image forming apparatus body 100. The sheets P ejected by the output roller pair 29 are sequentially stacked as output images on a stack tray 30.

Thus, a series of image forming processes performed by the image forming apparatus is completed.

Next, a detailed description is provided of a configuration and operation of the developing device as a supplied portion in the image forming device with reference to FIG. 2.

The developing device 5Y includes a developing roller 51 facing the photoconductor drum 1Y, a doctor blade 52 facing the developing roller 51, two conveying screws 55 disposed within the developer housings 53 and 54, and a toner concentration detector 56 to detect concentration of toner in developer. The developing roller 51 includes stationary magnets therein, a sleeve that rotates around the magnets, and the like. The developer housings 53 and 54 contain two-component developer including carrier (carrier particles) and toner (toner particles).

The developing device 5Y configured as described above operates as follows.

The sleeve of the developing roller 51Y rotates in a direction indicated by arrow in FIG. 2. The developer is carried on the developing roller 51 by a magnetic field generated by the magnets. As the sleeve rotates, the developer moves along a circumference of the developing roller 51.

The percentage (concentration) of toner in the developer (ratio of toner to carrier) in the developing device 5Y is constantly adjusted within a predetermined range. Specifically, the toner supply device 90 as a supply device supplies toner from the toner container 32Y to the developer housing 54 as the toner is consumed in the developing device 5Y.

The toner supplied to the developer housing 54 is stirred and mixed with the developer and circulated through the two developer housings 53 and 54 by the two conveying screws 55. In FIG. 2, the two conveying screws 55 move the developer in a longitudinal direction perpendicular to a plane on which FIG. 2 is illustrated. The toner in the developer is triboelectrically charged by friction with the carrier and electrostatically attracted to the carrier. Then, the toner is borne on the developing roller 51 together with the carrier by magnetic force generated on the developing roller 51.

The developer borne on the developing roller 51 is carried in a direction indicated by arrow in FIG. 2 to the doctor blade 52. The doctor blade 52 adjusts the amount of the developer borne on the developing roller 51 to an appropriate amount. Thereafter, the developer on the developing roller 51 is conveyed to a position opposite the photoconductor drum 1Y (i.e., a developing area). An electric field generated in the developing area moves the toner in the developer so that the electrostatic latent image formed on the photoconductor drum 1Y attracts the toner. Subsequently, as the sleeve rotates, the developer remaining on the developing roller 51 reaches an upper portion of the developer housing 53 and separates from the developing roller 51.

Next, with reference to FIG. 3, a configuration and operation of the toner supply device 90 as the supply device is briefly described.

In the toner supply device 90 as the supply device to supply powder to the supplied portion, the toner container 32Y as the powder container is installed in the installation port 31, and a toner container body 33 of the toner container 32Y rotates in a predetermined direction that is the direction indicated by arrow in FIG. 3 to discharge the toner contained in the toner container 32Y to the outside of the toner container 32Y. The toner supply device 90 includes a toner supply route (that is a toner transport route) and guides the toner to the developing device 5Y as the supplied portion via a sub-hopper 70.

To easily understand the configuration of the toner supply device 90, FIG. 3 illustrates the toner container 32Y, the toner supply device 90, and the developing device 5Y in different arrangement directions. In reality, the longitudinal axis of the toner container 32Y and a part of the toner supply device 90 is perpendicular to the surface of the paper on which FIG. 3 is drawn as illustrated in FIG. 1. In addition, the orientation and arrangement of a conveyance tube 95 and a conveyance pipe 96 are also illustrated in a simplified manner.

The toner supply devices 90 supply the color toners contained in the toner containers 32Y, 32M, 32C, and 32K installed in the installation port 31 in the image forming apparatus body 100 to the corresponding developing devices 5Y, 5M, 5C, and 5K, respectively. An amount of toner supplied to each developing device 5 is determined based on the amount of toner consumed in the corresponding developing devices 5. The four toner supply devices 90 have a similar configuration except the color of the toner used in the image forming processes.

Figure 4A:
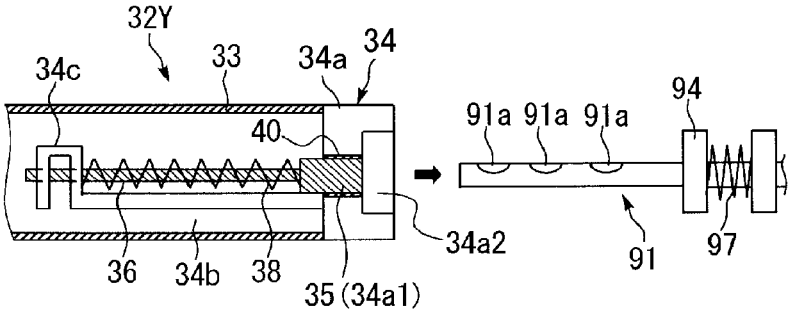
FIGS. 4A and 4B are schematic views illustrating processes to install a toner conveyance nozzle into a toner container set in the toner supply device in FIG. 3.
Figure 4B:
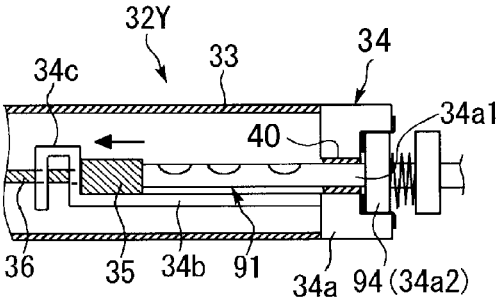

Specifically, referring to FIGS. 3, 4A, and 4B, installing the toner container 32Y in the installation port 31 of the image forming apparatus body 100 causes a toner conveyance nozzle 91 of the image forming apparatus body 100 to push and move the shutter 35 of the toner container 32Y. As a result, the toner conveyance nozzle 91 is inserted into the toner container 32Y (a container body 33) through a through hole 34*a*1. Accordingly, the toner contained in the toner container 32Y can be discharged through the toner conveyance nozzle 91.

In addition, the toner container 32Y includes a grip 33*d* having an outer radius smaller than an outer radius of the toner container body 33 at the bottom of the toner container 32Y that is a left end of the toner container body 33 in FIG. 3 so that a user can easily handle and install the toner container 32Y in the installation port 31. The user grips the grip 33*d* to install the toner container 32Y in the installation port 31 and take out the toner container 32Y from the installation port 31.

As illustrated in FIG. 3, the toner container 32Y includes the toner container body 33 having a helical groove 33*a* extending in the longitudinal direction of the toner container 32Y that is the lateral direction in FIG. 3. The helical groove 33*a* is formed from an outer circumferential surface toward an inner circumferential surface of the toner container body 33 and extends from the bottom to the vicinity of the head of the toner container body 33 so that rotations of the toner container body 33 transport the toner in the toner container body 33 from the left to the right in FIG. 3. The toner conveyed from the left to the right in FIG. 3 inside the toner container body 33 is discharged to the outside of the toner container 32Y through the toner conveyance nozzle 91.

In addition, the toner container 32Y includes a gear 37 meshing with the drive gear 110 of the image forming apparatus body 100. The gear 37 is disposed on the outer circumferential surface of the head of the toner container body 33 that is on the right side of the toner container body 33 in FIG. 3. Installing the toner container 32Y in the installation port 31 causes the gear 37 of the toner container body 33 to mesh with the drive gear 110 of the image forming apparatus body 100. As a drive motor 115 is driven, the driving force is transmitted from the drive gear 110 to the gear 37, thus rotating the toner container body 33. The drive motor 115 and the drive gear 110 serve as a driver to rotate the toner container body 33.

A configuration and operation of the toner container 32Y are described in further detail later.

Referring to FIG. 3, the conveyance screw 92 is disposed inside the toner conveyance nozzle 91. As a motor 93 rotates the conveyance screw 92, the conveyance screw 92 conveys the toner flowing into the toner conveyance nozzle 91 from the inflow port 91*a* (see FIG. 4A) in the toner container 32Y from the left to the right in FIG. 3. Thus, the toner is discharged through an outlet of the toner conveyance nozzle 91 to the hopper 81.

The hopper 81 is disposed below the outlet of the toner conveyance nozzle 91 via a downward path 82. A suction port 83 is disposed in the bottom portion of the hopper 81, and the suction port 83 is coupled to one end of the conveyance tube 95. The conveyance tube 95 is made of a flexible material with low affinity for toner, and the other end of the conveyance tube 95 is coupled to a developer pump 60 that is a diaphragm pump. The developer pump 60 is coupled to the developing device 5Y via the sub-hopper 70 and the conveyance pipe 96.

In the toner supply device 90 configured as described above, the drive motor 115 as the driver rotates the toner container body 33 of the toner container 32Y to discharge the toner in the toner container 32Y through the toner conveyance nozzle 91. The toner discharged from the toner container 32Y falls through the downward path 82 and is stored in the hopper 81. The developer pump 60 operates to suck the toner stored in the hopper 81 together with air from the suction port 83 and convey the toner from the developer pump 60 to the sub-hopper 70 via the conveyance tube 95. The toner conveyed to and stored in the sub-hopper 70 is appropriately supplied into the developing device 5Y via the conveyance pipe 96. That is, the toner in the toner container 32Y is transported in the direction indicated by dashed arrows in FIG. 3.

A toner detector 86 is disposed near the suction port 83 and indirectly detects that the toner contained in the toner container 32Y is depleted (toner depletion), or a state close thereto (toner near depletion). The toner is discharged from the toner container 32Y based on the detection result of the toner detector 86.

For example, a piezoelectric sensor or a light transmission sensor may be used as the toner detector 86. The height of the detection surface of the toner detector 86 is set so that the amount of toner (deposition height) deposited above the suction port 83 is a target value.

Based on the detection result of the toner detector 86, a drive timing and a drive duration of the drive motor 115 are controlled to rotationally drive the toner container 32Y (that is, the toner container body 33). Specifically, when the toner detector 86 detects that the toner is not deposited on the detection surface of the toner detector 86, the drive motor 115 is driven for a predetermined time. When the toner detector 86 detects that the toner is present on the detection surface, the drive motor 115 stops. If the toner detector 86 continuously detects that the toner does not exist at the detection surface even when the above-described control is performed repeatedly, a controller of the image forming apparatus determines that the toner contained in the toner container 32Y is depleted (toner depletion), or is close thereto (toner near depletion).

Figure 5:
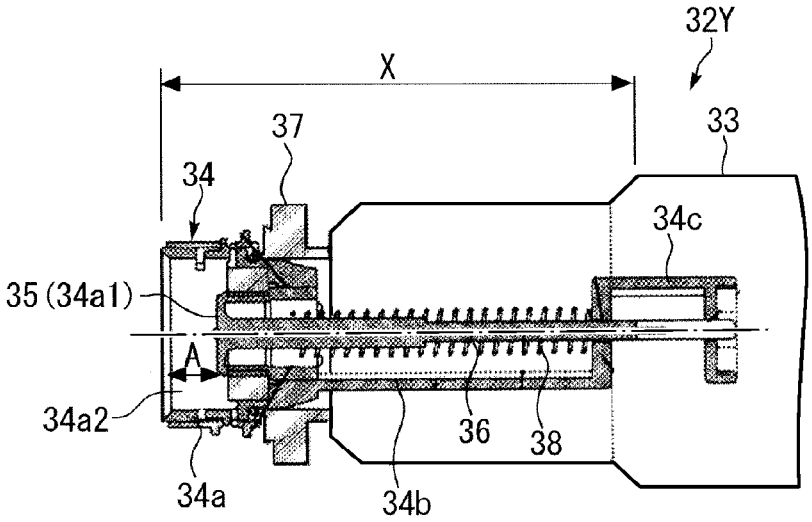
FIG. 5 is a sectional view illustrating a main part of the toner container.

Next, referring to FIGS. 4A, 4B, and 5, the following describes the toner container 32Y (and 32M, 32C, and 32K) as the powder container.

FIG. 5 is a side view illustrating a side of the toner container 32 opposite the side illustrated in FIGS. 4A and 4B. That is, the right and left parts in FIG. 5 are reversed in FIGS. 4A and 4B.

As described above with reference to FIGS. 1 to 3, the toner container 32Y contains toner therein and is detachably attached to the image forming apparatus body 100.

Referring to FIGS. 4A, 4B, and 5, the toner container 32Y includes the toner container body 33, a holder 34, the shutter 35, a rod 36, a compression spring 38, and the like. The holder 34 includes an attachment 34*a* functioning as a cap. The toner container body 33 is a bottle rotatable relative to the attachment 34*a* of the holder 34 and has a helical projection 33*a*1 formed on the inner circumferential surface thereof.

When the toner container 32Y is installed in the installation port 31 of the image forming apparatus body 100, the holder 34 including the attachment 34*a*, the shutter 35, the rod 36, and the compression spring 38 is held not to rotate, and the drive motor 115 as the driver installed in the image forming apparatus body 100 rotates the toner container body 33 to discharge the toner contained in the toner container 32Y through the toner conveyance nozzle 91.

In addition, as illustrated in FIG. 5, the toner container 32Y has a small diameter portion X having an outer diameter smaller than outer diameters of other portions and formed on one end of the toner container 32Y in the longitudinal direction of the toner container 32Y. The toner conveyance nozzle 91 (see FIG. 4B) is inserted into the small diameter portion X, and the small diameter portion X functions as a discharge portion disposed at one end of the powder container body to discharge the toner in the toner container 32Y to the outside of the toner container 32Y.

With reference to FIGS. 4A, 4B, and 5, the shutter 35 opens and closes the through hole 34*a*1 in conjunction with the installation of the toner container 32Y in the image forming apparatus body 100, and the toner conveyance nozzle 91 (installed in the image forming apparatus body 100A) is inserted into the through hole 34*a*1. The shutter 35 is made of a resin material and molded together with the rod 36 in one-piece, which is described later. The shutter 35 fits into the through hole 34*a*1 from the inside of the toner container 32Y and latched so as not to be removed from the toner container body 33. When the shutter 35 closes the through hole 34*a*1, no toner is discharged from the toner container 32Y. When the shutter 35 opens the through hole 34*a*1, the toner can be discharged from the toner container 32Y.

The through-hole 34*a*1 is a substantially cylindrical through-hole centered on the center of rotation of the toner container body 33. The shutter 35 is a cap shaped to fit into the through-hole 34*a*1 having such a cylindrical shape.

The toner container 32Y includes a seal 40 to seal a gap around the shutter 35 closing the through-hole 34*a*1.

Specifically, the seal 40 is made of an elastic material such as foamed polyurethane or felt and sticked to an entire inner circumferential surface of the through-hole 34*a*1 of the attachment 34*a*. When the shutter 35 closes the through hole 34*a*1, the seal 40 seals the gap around the shutter 35 to prevent the toner in the toner container body 33 from leaking out of the through-hole 34*a*1 of the toner container body 33.

When the shutter 35 opens the through hole 34*a*1, the seal 40 seals a gap between the attachment 34*a* and the toner conveyance nozzle 91 inserted into the through-hole 34*a*1 to prevent the toner in the toner container body 33 from leaking out of the through-hole 34*a*1.

The rod 36 is united with the shutter 35. The rod 36 extends in the opening and closing direction of the shutter 35 (in the lateral direction in FIGS. 4A, 4B, and 5) inside the toner container 32Y.

As illustrated in FIG. 5, the rod 36 is disposed so that the axis of the rod 36 substantially coincides with the center of rotation of the toner container body 33. Accordingly, even if the unexpected rotational force indirectly acts on the rod 36 held stationary when the toner container body 33 rotates, the position of the shutter 35 is not likely to shift.

With reference to FIGS. 4A, 4B, and 5, the holder 34 includes a holding portion 34*c*, the attachment 34*a* as the cap, a bridge portion 34*b* and the like and is a stationary member secured not to rotate when installed in the image forming apparatus body 100.

The holding portion 34*c* of the holder 34 is located on the opposite side (left side in FIGS. 4A and 4B, and right side in FIG. 5) to the shutter 35 installed inside the toner container 32Y. The holding portion 34*c* includes two portions to support the rod 36 movably in the opening and closing direction.

The attachment 34*a* as the cap of the holder 34 has the through-hole 34*a*1 and extends in a direction in which the toner conveyance nozzle 91 is inserted, that is, a lateral direction in FIGS. 4A, 4B, and 5. The attachment 34*a* is fitted to the toner container body 33 so as to be rotatable relative to the toner container body 33.

The attachment 34*a* has an opening 34*a*2 that opens a portion to insert the toner conveyance nozzle 91, that is, the right end of the toner container 32Y in FIGS. 4A and 4B and the left end of the toner container 32Y in FIG. 5. The opening 34*a*2 is a substantially cylindrical recess centered on the rotation center of the toner container body 33.

The attachment 34*a* includes an engagement portion to engage with an engaged portion formed in the installation port 31 so as to secure the attachment 34*a* to the installation port 31 in the circumferential direction of the toner container body. The above-described configuration positions the holder 34 so that the bridge portion 34*b* is under the rod 36 in the toner container 32Y installed in the image forming apparatus body 100.

The bridge portion 34*b* of the holder 34 connects the holding portion 34*c* and the attachment 34*a* inside the toner container body 33 of the toner container 32Y.

The compression spring 38 as a biasing member is wound around the rod 36 between the shutter 35 and the holding portion 34*c* and faces the bridge portion 34*b*. The compression spring 38 urges the shutter 35 in the direction of closing the through-hole 34*a*1 (to the right in FIGS. 4A and 4B, and to the left in FIG. 5).

In the above-described configuration, installing the toner container 32Y in the installation port 31 of the image forming apparatus body 100 causes the toner conveyance nozzle 91 to push the shutter 35, move the shutter 35 together with the rod 36 to the inside of the toner container 32Y against an urging force of the compression spring 38 as the biasing member, and open the through-hole 34*a*1. Specifically, the shutter 35 (and the rod 36) moves as illustrated in the order of FIGS. 4A and 4B to open the through-hole 34*a*1.

Conversely, removing the toner container 32Y from the installation port 31 of the image forming apparatus body 100 causes the toner conveyance nozzle 91 to release the shutter 35 from the above-described pushed state, and the urging force of the compression spring 38 moves the shutter 35 together with the rod 36 toward the through hole 34*a*1 to close the through-hole 34*a*1. Specifically, the shutter 35 (and the rod 36) moves as illustrated in the order of FIGS. 4B and 4A to close the through-hole 34*a*1.

As illustrated in FIG. 4B, when the installation of the toner container 32Y in the image forming apparatus body 100 is completed, the shutter 35 contacts the holding portion 34*c*, and the compression spring 38 is accommodated in the recess of the shutter 35. The above-described configuration can prevent the disadvantage that the toner in the toner container 32Y adheres to the compression spring 38 when the toner container 32Y is set in the image forming apparatus body 100.

Referring to FIG. 4, the toner supply device 90 in the present embodiment includes an engagement portion 94 on the toner conveyance nozzle 91. The engagement portion 94 engages the opening 34*a*2 in conjunction with an operation to install the toner container 32Y in the installation port 31, that is, the operation that insert the toner conveyance nozzle 91 into the through-hole 34*a*1.

Specifically, the engagement portion 94 has a substantially columnar shape having an outer radius larger than that of a main portion of the toner conveyance nozzle 91 and engages the opening 34*a*2 of the attachment 34*a*. In addition, the engagement portion 94 is disposed to slide along the main portion of the toner conveyance nozzle 91 in a mounting direction of the toner container 32Y. Additionally, a compression spring 97 is set on the toner conveyance nozzle 91 to push the engagement portion 94 toward the bottom of the toner container 32Y in the mounting direction, that is, the leftward in FIG. 4.

In the above-described configuration, installing the toner container 32Y in the installation port 31 of the image forming apparatus body 100 insert the toner conveyance nozzle 91 into the toner container 32Y, and the compression spring 97 pushes the engagement portion 94 to engage the opening 34*a*2. Conversely, removing the toner container 32Y from the image forming apparatus body 100 pulls out the toner conveyance nozzle 91 from the toner container 32Y and pulls out the engagement portion 94 from the opening 34*a*2.

Next, referring to FIGS. 6 to 9, the configuration and operations regarding the toner container 32Y (and 32M, 32C, and 32K) as the powder container in the present embodiment are described below.

The toner container 32Y is a substantially cylindrical powder container that stores toner as powder.

The toner container 32Y includes a helical projection 33*a*1 (see FIGS. 6 and 8) extending in the longitudinal direction of the toner container 32Y on an inner circumferential surface 33C of the toner container body 33 as the powder container rotating in a predetermined direction. The projection 33*a*1 is a conveyer to convey the toner contained in the toner container body 33 in the longitudinal direction that is an axial direction of the toner container body rotating in the predetermined direction, the lateral direction in FIG. 2, and a direction perpendicular to a plane on which FIG. 7 is illustrated.

The helical projection 33*a*1 is formed by the helical groove 33*a* described above. That is, the helical projection 33*a*1 corresponds to the helical groove 33*a*. That is, forming the helical groove 33*a* from the outer circumferential surface toward the inner circumferential surface of the toner container body 33 forms the helical projection 33*a*1 (projecting from the inner circumferential surface toward the inside) on the inner circumferential surface 33C.

Rotating the toner container body 33 of the toner container 32Y including the helical projection 33*a*1 about the rotation axis conveys the toner stored in the toner container body 33 to one end of the toner container body 33 in the longitudinal direction of the toner container body 33 (that is, to the small diameter portion X as the discharge portion) by a screw effect.

Figure 6:
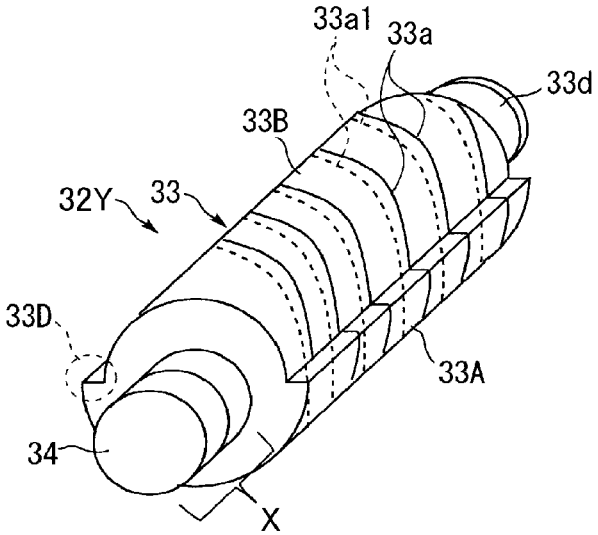
FIG. 6 is a perspective view of the toner container according to the embodiment of the present disclosure.
Figure 7:
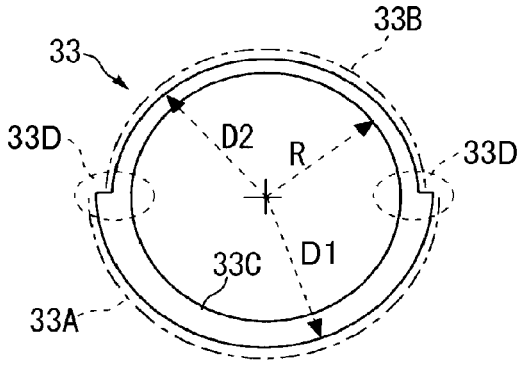
FIG. 7 is a sectional view of the toner container in FIG. 6.
Figure 8:
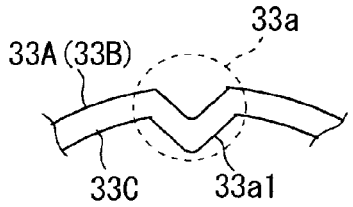
FIG. 8 is a partial enlarged sectional view illustrating a groove of the toner container in FIG. 6.

As illustrated in FIG. 6, the toner container 32Y in the present embodiment includes a large outer diameter portion 33A and a small outer diameter portion 33B.

Specifically, as illustrated in FIG. 7, the toner container 32Y includes the large outer diameter portion 33A having a large outer diameter (D1×2) and the small outer diameter portion 33B having a smaller outer diameter (D2×2) than the large outer diameter in a cross section orthogonal to the longitudinal direction (that is the rotational axis) of the toner container 32Y. The large outer diameter portion 33A and the small outer diameter portion 33B are connected at boundary portions 33D. The toner container 32Y has the inner circumferential surface 33C inside that forms a substantial circle in the cross section. The radius D1 of the large outer diameter portion 33A is larger than the radius D2 of the small outer diameter portion 33B, that is, D1>D2. The inner circumferential surface 33C forms the circle having a radius R inside the toner container 32Y.

In other words, the main portion of the toner container 32Y (that is the toner container body 33) does not have a complete cylindrical shape but is formed by connecting cylinders (semi-cylinders) having different outer diameters. The cylinders (semi-cylinders) having different outer diameters connect at the boundary portions, and the boundary portion forms a stepped surface.

In the toner container 32Y configured as described above, the helical groove 33*a* is continuously formed in the longitudinal direction crossing across the large outer diameter portion 33A and the small outer diameter portion 33B and forms the helical projection 33*a*1 on the inner circumferential surface 33C.

In other words, in order to orderly form the helical projection 33*a*1 on the inner circumferential surface 33C, the helical groove 33*a* is formed so that the phase of the helical groove in the large outer diameter portion 33A coincides with the phase of the helical groove in the small outer diameter portion 33B at the boundary portion 33D.

The above-described configuration smoothly conveys the toner in the toner container 32Y in the longitudinal direction.

Figure 9:
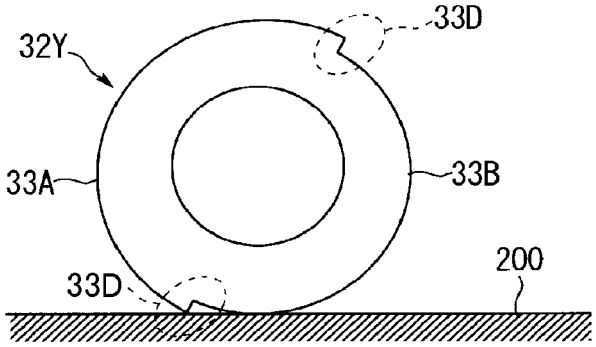
FIG. 9 is a schematic view illustrating the toner container in FIG. 6 placed on a placement surface.

The toner container 32Y in the present embodiment including the large outer diameter portion 33A and the small outer diameter portion 33B as described above hardly rolls even when the toner container 32Y alone is placed on a placement surface 200 such as a floor surface or a table surface as illustrated in FIG. 9 because the boundary portion 33D has the stepped surface that sticks with of the placement surface 200.

Even when the toner container 32Y containing new toner is stored in a packing box, the toner container 32Y hardly rolls inside the packing box because the stepped surface of the boundary portion 33D sticks with an inner wall face of the packing box.

The boundary portion 33D of the toner container 32Y functions as a rib to increase the mechanical strength of the toner container 32Y Accordingly, the toner container 32Y is less likely to be damaged even when the toner container 32Y is dropped and receives an impact. The toner container 32Y is less likely to be crushed even when a robot arm in an automated manufacturing factory holds the toner container 32Y.

In addition, driving to rotate the toner container 32Y (that is, the toner container body 33) on the installation port 31 of the image forming apparatus causes vibration in the toner container 32Y when the boundary portion 33D having the stepped surface passes through the installation surface of the installation port 31. The vibration appropriately loosens the toner stored inside the toner container 32Y, and the toner is less likely to aggregate.

The boundary portion 33D in the present embodiment has the stepped surface formed in a radial direction of the toner container 32Y by the difference between outer diameters of the large outer diameter portion 33A and the small outer diameter portion 33B, that is, (D1×2−D2×2).

That is, the stepped surface formed at the boundary portion 33D between the large outer diameter portion 33A and the small outer diameter portion 33B in the toner container 32Y (that is the toner container body 33) does not have a gentle shape with rounded corners but has a shape with a sharp corner.

Such a shape easily exhibits an effect that prevents the toner container 32Y from rolling on the placement surface 200.

In the present embodiment, each of the large outer diameter portion 33A and the small outer diameter portion 33B is formed to be a semicircle or a substantial semicircle in the circumferential direction on the cross section of the toner container 32Y.

That is, as illustrated in FIG. 7, each of the large outer diameter portion 33A and the small outer diameter portion 33B is formed to be an arc shape having about 180 degrees of central angle in the circumferential direction in the cross section orthogonal to the longitudinal direction of the toner container 32Y.

The above-described configuration can properly prevent the toner container 32Y from rolling by 180 degrees or more in both the clockwise direction and the counterclockwise direction.

As described above, the helical projection 33*a*1 in the present embodiment functions as the conveyer that conveys the toner stored in the toner container body 33 toward the small diameter portion X as the discharge portion.

As illustrated in FIG. 6, the large outer diameter portion 33A and the small outer diameter portion 33B are formed to be most of part of the toner container body 33 in the longitudinal direction except at least the small diameter portion X as the discharge portion. In detail, the toner container 32Y includes the small diameter portion X, the grip 33*d* (see FIG. 3), the large outer diameter portion 33A, and the small outer diameter portion 33B in the longitudinal direction, and the most of part of the toner container body 33 in the longitudinal direction is the large outer diameter portion 33A and the small outer diameter portion 33B. Both the small diameter portion X and the grip 33*d* do not have a large outer diameter portion and a small outer diameter portion like the toner container body 33. The small diameter portion X and the grip 33*d* may have the same outer diameter.

The toner container 32Y does not have a part having a larger diameter than the large outer diameter portion 33A. In particular, each of the small diameter portion X and the grip 33*d* has a smaller outer diameter than the small outer diameter portion 33B.

The above-described configuration easily exhibits the effect of preventing rolling of the container that is given by the boundary portion 33D (that is, the stepped surface) between the large outer diameter portion 33A and the small outer diameter portion 33B.

In the present embodiment, the toner container body 33 of the toner container 32Y is manufactured by molding as a single piece. Specifically, the toner container body 33 is manufactured by biaxial stretch blow molding.

The toner container body 33 of the toner container 32Y manufactured as described above can have a stronger overall mechanical strength and a lower production cost than a toner container body manufactured by joining the large outer diameter portion 33A and the small outer diameter portion 33B that are separately formed.

Next, a variation of the present embodiment is described.

Figure 10:
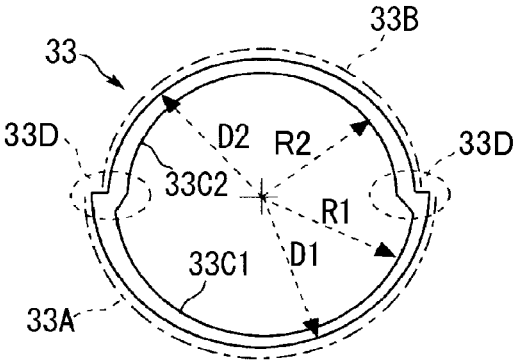
FIG. 10 is a sectional view of a toner container according to a variation.

As illustrated in FIG. 10, the toner container 32Y according to the variation also includes the large outer diameter portion 33A and the small outer diameter portion 33B.

However, the toner container 32Y in the variation is different from that illustrated in FIG. 7 in that the thickness of the large outer diameter portion 33A is formed to be equal to the thickness of the small outer diameter portion 33B. Therefore, the radius R1 of the inner circumferential surface 33C1 of the large outer diameter portion 33A is larger than the radius R2 of the inner circumferential surface 33C2 of the small outer diameter portion 33B (that is, R1>R2).

Even in the above-described configuration, the helical projection 33*a*1 continuously formed on the inner circumferential surfaces 33C1 and 33C2 can prevent disadvantage that the conveyance property of the toner deteriorates. Uniformly forming the thickness of the toner container 32Y improves the balance of the strength of the toner container 32Y.

As described above, the toner container 32Y in the present embodiment is the substantially cylindrical toner container 32Y as the powder container to store the toner as the powder and includes the projection 33*a*1 as the conveyer to convey the toner stored inside the toner container 32Y in the longitudinal direction of the toner container 32Y. Additionally, in the cross section orthogonal to the longitudinal direction, the toner container 32Y includes the large outer diameter portion 33A having a large outer diameter (D1×2) and the small outer diameter portion 33B having a smaller outer diameter (D2×2) than the large outer diameter. The large outer diameter portion 33A and the small outer diameter portion 33B are connected at the boundary portions 33D.

The above-described configuration can provide the toner container 32Y that is less likely to roll even when placed on the placement surface 200.

In the above-described embodiments, the present disclosure is applied to the toner container 32Y as the powder container in which toner (one-component developer) as powder is stored and collected but is not limited to this. For example, the present disclosure may be applied to a powder container in which a two-component developer as powder is stored and collected. The two-component developer is a mixture of toner and carrier.

In the above-described embodiments, the present disclosure is applied to the toner container 32Y as the powder container including the small diameter portion X as the discharge portion into which the toner conveyance nozzle 91 is inserted, but is not limited to this. The present disclosure may be applied to all powder containers having the substantially cylindrical form.

In such configurations, effects similar to those described above are also attained.

Numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

The present disclosure is not limited to the above-described embodiment and variations, and the configuration of the present embodiment can be appropriately modified other than suggested in the above embodiment and variations within a scope of the technological concept of the present disclosure. The number, position, and shape of each of the components described above are not limited to the embodiment and variations described above. Desirable number, position, and shape can be determined to perform the present disclosure.

What is claimed is:

1. A powder container comprising a powder container body, at least a portion of the container body including at least a partially cylindrical surface, the powder container body to store powder, the powder container body including:

a conveyer to convey the powder stored in the powder container body in a longitudinal direction of the powder container body, a large outer diameter portion having an outer diameter on a cross section orthogonal to the longitudinal direction, a small outer diameter portion having an outer diameter smaller than the outer diameter of the large outer diameter portion on the same cross section, and a boundary portion connecting the large outer diameter portion and the small outer diameter portion.

2. The powder container according to claim 1, wherein the conveyer is a helical projection extending in the longitudinal direction on an inner circumferential surface of the powder container body to rotate.

3. The powder container according to claim 2, wherein the projection corresponds to a helical groove extending in the longitudinal direction and continuously connecting the large outer diameter portion and the small outer diameter portion.

4. The powder container according to claim 1, wherein the boundary portion includes a stepped surface including a difference in a radial direction of the powder container body between the outer diameter of the large outer diameter portion and the outer diameter of the small outer diameter portion.

5. The powder container according to claim 1, wherein the powder container does not include a portion having an outer diameter larger than the outer diameter of the large outer diameter portion.

6. The powder container according to claim 1, wherein the powder container is molded as a single piece.

7. A powder supply device to supply powder to a supplied portion, the powder supply device comprising the powder container according to claim 1, wherein the powder container is detachably attached to the powder supply device.

8. An image forming apparatus comprising the powder container according to claim 1, wherein the powder container is detachably attached to the image forming apparatus.

9. The powder container according to claim 1, wherein:

the large outer diameter portion is a semicircle on the cross section and the small outer diameter portion is a semicircle on the cross section.

10. The powder container according to claim 1, further comprising:

a discharge portion disposed at one end of the powder container body and to discharge the powder, wherein the conveyer is to convey the powder stored in the powder container body toward the discharge portion, and wherein the large outer diameter portion and the small outer diameter portion extends across an entire area of the powder container in the longitudinal direction of the powder container body except at least the discharge portion.

11. A powder container comprising a powder container body, the powder container body to store powder, the powder container body including:

a conveyer to convey the powder stored in the powder container body in a longitudinal direction of the powder container body, a large outer diameter portion having an outer diameter on a cross section orthogonal to the longitudinal direction, a small outer diameter portion having an outer diameter smaller than the outer diameter of the large outer diameter portion on the cross section, and a boundary portion connecting the large outer diameter portion and the small outer diameter portion, wherein the large outer diameter portion is a semicircle on the cross section and wherein the small outer diameter portion is a semicircle on the cross section.

12. A powder container comprising a powder container body, the powder container body to store powder, the powder container body including:

a conveyer to convey the powder stored in the powder container body in a longitudinal direction of the powder container body, a large outer diameter portion having an outer diameter on a cross section orthogonal to the longitudinal direction, a small outer diameter portion having an outer diameter smaller than the outer diameter of the large outer diameter portion on the cross section, a boundary portion connecting the large outer diameter portion and the small outer diameter portion, and a discharge portion disposed at one end of the powder container body and to discharge the powder, wherein the conveyer is to convey the powder stored in the powder container body toward the discharge portion, and wherein the large outer diameter portion and the small outer diameter portion extends across an entire area of the powder container in the longitudinal direction of the powder container body except at least the discharge portion.

* * * * *